US006540628B1

(12) United States Patent
Musacchia, Jr.

(10) Patent No.: US 6,540,628 B1
(45) Date of Patent: Apr. 1, 2003

(54) BROADHEAD ARROWHEAD WITH ADJUSTABLE BLADE RETENTION

(75) Inventor: John M. Musacchia, Jr., Douglasville, GA (US)

(73) Assignee: Muzzy Products Corporation, Cartersville, GA (US)

( * ) Notice: Subject to any disclaimer, the term of this patent is extended or adjusted under 35 U.S.C. 154(b) by 0 days.

(21) Appl. No.: 09/679,660

(22) Filed: Oct. 4, 2000

(51) Int. Cl.[7] ..... F42B 6/08
(52) U.S. Cl. ..... 473/583; 473/584
(58) Field of Search ..... 473/583, 584

(56) References Cited

U.S. PATENT DOCUMENTS 2,940,758 A * 6/1960 Richter
3,741,542 A 6/1973 Karbo
3,910,579 A 10/1975 Sprandel
4,146,226 A 3/1979 Sorensen
4,210,330 A 7/1980 Kosbab
4,349,202 A 9/1982 Scott
4,452,460 A * 6/1984 Adams
4,986,550 A 1/1991 Segovia
5,482,294 A 1/1996 Sullivan et al.

* cited by examiner

*Primary Examiner*—John A. Ricci
(74) *Attorney, Agent, or Firm*—Gerald E. Helget; Nelson R. Capes; Briggs and Morgan

(57) ABSTRACT

The present invention is an archer's broadhead having blade elements supported by a mandrel preferably disposed in a longitudinally extending ferrule. The blade can incorporate a flange portion or a loop. The mandrel preferably comprises threaded portions and incorporates a collar, which collar is adjustable along the length of the mandrel. The ferrule defines a longitudinally extending central cavity and a plurality of ferrule slots extending from and communicating with the central cavity. Upon broadhead assembly, the flange portion (or loop) of the blade is located in the ferrule cavity between the outer surface of the mandrel and the inner surface of the ferrule. The arrowhead tip can engage a top section of the mandrel, a top section of the ferrule, or both, to secure the top of the blade elements and mandrel to the ferrule. The broadhead fixedly secures to an arrow shaft at a mounting component.

15 Claims, 8 Drawing Sheets

BROADHEAD ARROWHEAD WITH ADJUSTABLE BLADE RETENTION

BACKGROUND OF THE INVENTION

1. Field of the Invention

The present invention relates to an archery broadhead and more particularly to an improved broadhead having adjustable blade retention and replaceable blade elements.

2. Description of Related Art

Many types of arrows are known and available for shooting with an archer's bow. An archer's choice of a particular arrow depends on the intended activity or use for the arrow. For example, arrows used for competitive target shooting generally differ from those used for hunting.

The sport of archery includes activities ranging from target practice to game hunting, and the art of providing arrows suitable for each of these purposes has become highly developed. Many types of arrowheads have been designed to serve a particular purpose, each having specific operating characteristics. Thus, arrowheads specifically intended for hunting large, thick-skinned, heavy-boned game such as bear have been advanced as well as those with heads particularly suitable for hunting large, thinner-skinned, lighter-boned game such as deer. Arrowheads also have been developed for hunting fowl, particularly turkey, for hunting squirrels and other small game, and for bow fishing.

Arrows used for hunting typically comprise an arrow shaft and an arrowhead commonly referred to as a broadhead. The broadhead is mounted at a tip end of the arrow shaft opposite an arrow string engaging nock. Conventional broadheads typically comprise a central ferrule that mounts a plurality of broadhead blade elements, each blade element presenting an inclined, razor sharp edge. Broadheads are designed for the purpose of striking and piercing a target, such as a game animal, and consequently the blades are designed to inflict a wound exhibiting profuse bleeding.

Broadhead blade elements typically resemble triangularly shaped razor blades. Two or more blade elements are mounted in longitudinally extending slots formed in the broadhead ferrule. The blades can be fixedly secured in the ferrule slots by several means.

Broadheads are easily damaged during use. The blade elements, and particularly the razor sharp edge defined along portions of the blade element, are susceptible to damage due to missed shots or when the archer makes his shot but the broadhead strikes a large bone of a game animal. If a shot is missed the broadhead may strike rocks or other hard objects that break the blade element or cause severe nicks in the blades' sharpened edges. Even when the arrow hits its mark, the broadhead may hit a large bone causing the blade elements to break. This usually occurs when the broadhead hits the large bone obliquely and glances off the bone thereby imparting most of the impact energy along one blade element.

One consequence of broken blade elements is that the arrow cannot be used until the broadhead is repaired. This is so because a broadhead with broken and/or missing blade elements are statically and aerodynamically unbalanced. This unbalanced condition prevents a launched arrow from traveling the intended and predictable trajectory. Also, if the arrow with a damaged broadhead does hit its mark, the broadhead may not inflict the type or quality of wound that is humanely desired by bow hunters.

When such a broadhead is attached to the arrow shaft in non-releasable fashion, it is necessary for the archer to have a wide range of arrows, some for target shooting, some for hunting larger game and some for smaller game. Arrows having interchangeable heads were developed in an effort to reduce the number of arrow shafts which might be required, as in U.S. Pat. No. 2,289,284 to Chandler and U.S. Pat. No. 3,910,579 to Sprandel, but such approaches require replacement of the entire broadhead, and therefore have the drawback that a new complete broadhead must be manufactured for each intended use.

Arrowheads with interchangeable blades also have been developed in an effort to increase the versatility of the arrowhead. Systems typical of this general approach are disclosed in U.S. Pat. No. 2,940,758 to Richter, U.S. Pat. No. 4,036,479 to Sherwin, and U.S. Pat. No. 4,146,226 to Sorenson. Such systems generally employ a plurality of independent blades each of which can be fitted into a different one of a plurality of slots in the ferrule. Usually, the blades are then clamped by axially-acting clamp members which are separate from the arrowhead body, or the body itself may act as a clamp member.

U.S. Patent No. 3,741,542 to Karbo and U.S. Pat. No. 4,349,202 to Scott illustrate prior art arrowheads in which blade assemblies comprising two or more blades are releasably secured to the arrowhead body. Though such arrowheads represent a distinct improvement in the art, they have the deficiency that, when the blades are of substantial size, the clamping forces are applied to only a limited portion of the blade; therefore, the blade is likely to fracture or distort under the rigors of use. In other approaches, as in U.S. Pat. No. 3,398,960 to Carroll, a blade structure is positioned over a central shaft and locked thereto, but such approaches have the deficiency that the entire blade structure is external and more easily deformed or loosened on impact. While these prior art proposals have achieved significant acceptance in the trade, there has been a continuing need for improvement, particularly in the ease of assembly of the arrowhead and its ability, once assembled, to withstand the rigors of actual use.

U.S. Pat. No. 4,986,550 to Segovia discloses one means for fixedly securing blade elements in a broadhead. Segovia shows a broadhead comprising an arrowhead body or ferrule with longitudinally extending, radially oriented slots for accepting corresponding blade elements. Each blade element includes a central flange from which a sharpened blade extends. The blade flanges have acutely shaped projections at opposing ends. As shown in FIG. 1 of Segovia, one projection fits captively within a cooperating portion of the slot and the other projection is engaged by a cooperating washer, which, when compressed against the ferrule, fixedly secures the blade unit in the slot.

Another blade element securing means is shown in U.S. Pat. No. 4,210,330 to Kosbab. Kosbab shows, in FIG. 2 thereof, a modular broadhead having a central ferrule with blade engaging slots radially offset from the central axis of the ferrule in planes parallel to planes tangent to the peripheral surface of the ferrule. Each blade includes opposed acute angle projections that cooperate, at one end of the blade, with an annular groove formed in a tip that threaded engages the ferrule and, at the opposed end of the blade, with a ferrule collar. The engagement of the tip and ferrule collar with the acute angle projections secures the blade in captive engagement with the ferrule.

U.S. Pat. No. 5,482,294 to Sullivan et al. discloses an archery's broadhead having a longitudinally extending ferrule with a plurality of blade elements mounted by and extending from the ferrule. A securing flange extends from the blade body and extends through a ferrule slot into a ferrule cavity. An engaging bar is disposed in the ferrule cavity and engages portions of the securing flange of the blade element. Yet, the Sullivan et al. broadhead has several shortcomings.

As shown in FIGS. 5*a*–10 of Sullivan et al., the angular space between the outer surface of the engaging bar and the inner surface of the ferrule remains substantially empty upon broadhead assembly. While this configuration may provide a somewhat lighter broadhead, the broadhead assembly as a whole, including the blade elements and ferrule, provides suspect strength upon impact. Upon impact, the blade elements of a broadhead are exposed to significant longitudinal stresses along the length of the broadhead. The Sullivan et al. broadhead arrangement provides only a small surface area contact between the blade elements and the ferrule in a longitudinal configuration, detailing a second disadvantage to this broadhead. The securing flange 72 is truncated adjacent an arcuate side edge 84 which seats into the arcuate portion 62 of the slot 60 when the broadhead assembly 10 is assembled. The arcuate side edge 84 is undercut relative to the securing flange 72, forming a notch 86 which, when the blade 18 is seated into engagement with the ferrule 16, engages the blade support edge 64 of the ferrule 16. The notch 86 seated in support edge 64 only provides a minimum amount of protection to the blade element upon impact. Further, the alignment shoulder 34 of ferrule 16 simply provides alignment of the longitudinal axes of the broadhead assembly 10 and arrow shaft 14. The alignment shoulder is integral with the ferrule and cannot be adjusted longitudinally to further the snug fit of blade elements in the broadhead.

Therefore it can be seen that there is a need in the art for an archery broadhead having replaceable blade elements with adjustable blade retention.

BRIEF SUMMARY OF THE INVENTION

Briefly described, in its preferred form, the present invention comprises a broadhead including blade elements, a mandrel having an adjustable collar, a ferrule and a tip. The present broadhead overcomes the deficiencies in the prior art by providing an archery broadhead having adjustable blade retention and replaceable blade elements that are mechanically and captively engaged: first, between the arrowhead tip and the collar which is in communication with the broadhead mandrel, the tip and collar sandwiching the blades therebetween, limiting longitudinal movement of the blade elements; second, by ferrule slots from which the blades protrude through the ferrule, limiting rotational movement of the blade elements; and third, by removing any void space between the outer surface of the mandrel and the inner surface of the ferrule.

The present invention is an archer's broadhead having blade elements supported by a mandrel preferably disposed in a longitudinally extending ferrule. Each blade element defines a generally triangularly shaped blade body having a sharpened blade edge, which sharpened blade edge extends from a ferrule slot. A mandrel engaging portion of the blade extends from the mandrel edge of the blade body distal from the sharpened blade edge. The mandrel engaging portion can be a flange portion angularly displaced from the blade body. Alternatively, the mandrel engaging portion can be a loop extending from the mandrel edge.

The flange portion of the blade can extend substantially the entire length of the blade body, or can extend only a portion of the length of the blade. The flange portion also can extend arcuately from the blade body in varying arc lengths. The flange portion of the blade elements are designed to keep the blades in vertical alignment and in surface contact with the mandrel. The flange portion preferably "snaps" around an arcuate portion of the outer surface of the mandrel, locking the blade elements in position along the mandrel. Alternatively, blades with loops are retained by the mandrel via the loops through which the mandrel extends.

The mandrel preferably comprises threaded portions and incorporates a collar, which collar is adjustable along the length of the mandrel. The collar is designed as a stop supporting the back edge of the flange portion of each blade element, or supporting the back surface of the loop of the bottom blade element, which loop of the bottom blade element in turn supports the next highest loop of next blade element, and so on. This arrangement further secures the blades from longitudinal movement along the length of the mandrel.

The collar of the mandrel comprises a hard material, supports a substantial portion of the weight of the blade elements, and provides a stop against the longitudinal stresses borne by the blade elements upon the broadhead striking the target. Without the collar, the blade elements typically deform the ferrule body upon impact, thus necessitating replacement of the ferrule. Compounding this problem, the blade itself may also fail, requiring replacement. The present collar lessens such component failure. The hard material forming the collar is defined as a material that will support the impact of the blades upon striking the target without significant deformation to the collar. For example, conventional broadhead constructions support blade elements against an aluminum ferrule, which aluminum ferrule easily deforms upon blade contact with the target. The present invention rests portions of the blades against a collar made of, for example, steel, that can sustain blade impact without significant structural damage. Therefore, if a blade is damaged upon contact, the collar prevents damage to the ferrule and one only need replace the damaged blade element.

The collar of the mandrel is preferably rotationally secured to the bottom portion of the mandrel by threading so the collar can be adjusted vertically along the length of the mandrel, providing secure locking of the blade positions between the collar and the arrow tip. This arrangement provides a level of securing and alignment not achieved in conventional broadhead assemblies. Alternatively, the collar can be formed as an integral part of the bottom portion of the mandrel and the tip adjusted downward along the length of the top portion of the mandrel. In yet another embodiment, a collar may be inserted into the ferrule, then the blades, and then the mandrel. This embodiment can be used when the tip is integral with the mandrel.

The ferrule defines a longitudinally extending central cavity and a plurality of ferrule slots extending from and communicating with the central cavity. Upon broadhead assembly, the flange portion (or loop) of the blade is located in the ferrule cavity between the outer surface of the mandrel and the inner surface of the ferrule. The flange portion of the blade element is arcuate to extend around a portion of the outer surface of the mandrel.

The arrowhead tip can engage the top section of the mandrel, the top section of the ferrule, or both, to secure the top of the blade elements and mandrel to the ferrule.

The broadhead fixedly secures to an arrow shaft at a mounting component. Preferably, the mounting component comprises a ferrule extension, which ferrule extension provides a mounting portion adapted to be secured into a bore in the arrow shaft.

In one preferred embodiment, the broadhead comprises three blade elements, each blade element having a flange portion extending from the length of the blade and approximately 120 degrees around the outer surface of the mandrel. In another embodiment, each blade has a full loop extending from one-third the length of the blade, the loop having an inner diameter incrementally larger than the outer surface of the mandrel. In this embodiment, the mandrel slips within the stacked loops. The loop of the bottom blade rests atop the collar of the mandrel. The loop of the middle blade rests atop the loop of the bottom blade, and the loop of the top blade rests atop the loop of the middle blade.

Each blade can comprise more than one flange portion or loop, providing each separate flange portion or loop occupies a free portion of the length of the mandrel upon assembly of the broadhead. For example, if each blade incorporates more than one loop, this configuration is somewhat similar to the hinge of a door wherein the hinge panels are the blade elements having loops, and the pin is the mandrel.

In another preferred embodiment, each blade element can comprise flange portions running the length of the blade and extending incrementally less than 360/n degrees around the outer surface of the mandrel, where n equals the number of blade elements comprising the broadhead. In this embodiment, the back edge of each flange portion of each blade element rests atop a portion of the top surface of the collar.

In yet another preferred embodiment, the present broadhead assembly can comprise blade elements, a mandrel having an adjustable collar, a circumferential locking assembly and a tip. In this embodiment, the mandrel engaging portions of the blade elements are loops. The mandrel extends through the loop of each blade, wherein the assembly comprises at least two blades, a top and a bottom blade, where the loop of the bottom blade rests atop the collar. The circumferential locking assembly locks the blade elements from rotating individually, so if the blade elements rotate around the mandrel, they rotate as a single unit. The locking assembly can further lock the unity of blade elements from shifting circumferentially around the mandrel once the blades have been placed in proper alignment upon construction of the broadhead. Since the loops of the blades lay one atop another, and since the blades are secured from sliding on the mandrel both circumferentially (by the locking assembly) and lengthwise (by compression between the collar and the tip), this embodiment does not require a ferrule.

It will be appreciated that the present invention may be carried out with the elements forming the present broadhead constructed of various materials. Accordingly, wood, metal or plastics may be utilized and the latter may include glass fiber reinforced plastics. Quite obviously, these elements can be formed of any other suitable material exhibiting sufficient dimensional stability for use in this environment.

The broadhead of the present invention provides numerous advantages over conventional broadhead designs. For example, the broadhead of U.S. Pat. No. 5,482,294 to Sullivan et al. provides a blade support assembly wherein an arcuate side edge of the blade is undercut relative to a securing flange, forming a notch which, when the blade element is seated into engagement with a ferrule, engages the blade support edge with the ferrule. As shown in FIG. 4 of Sullivan et al., the notch 86 supports the blade element in the direction opposite the direction of broadhead travel. See also FIGS. 1, 2*a* and 2*b*. As shown, notch 86 provides little structural support for the blade element in this direction. Thus, when the Sullivan et al. broadhead strikes its target, the blade element typically fails at a site in proximity to notch 86.

Unlike the Sullivan et al. broadhead, the present broadhead provides a blade support assembly wherein preferably a substantial portion of the blade body is supported both longitudinally along a portion of the length of the blade, and tangentially along a flange portion or loop.

Thus, it is an object of the present invention to provide an improved archer's broadhead.

It is a further object of the present invention to provide a broadhead having blades that are replaceable and interchangeable.

It is another object of the present invention to provide a broadhead in which the blade elements are mechanically secured to the mandrel along substantially the entire length of a flange portion of the blade element.

It is another object of the present invention to provide a broadhead with a mandrel having an adjustable collar.

Another object of the present invention is to provide a blade assembly that better supports each blade from longitudinal stresses when the broadhead hits its target.

These and other objects, features and advantages of the present invention will become more apparent upon reading the following specification in conjunction with the accompanying drawing figures.

DETAILED DESCRIPTION OF THE PREFERRED EMBODIMENTS

Figure 1:
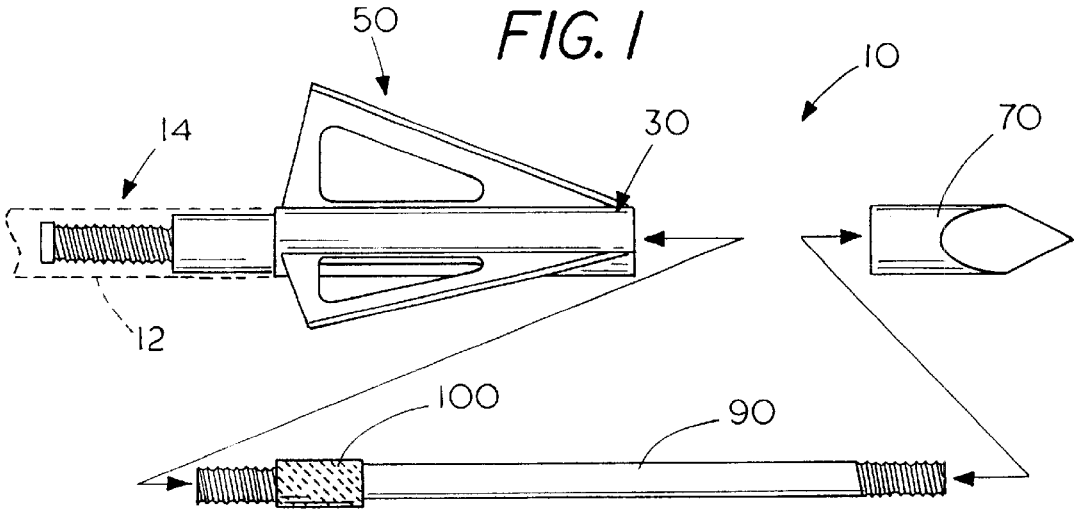
FIG. 1 is a perspective view of a preferred embodiment of the present broadhead assembly shown adapted in engagement with an arrow shaft.

Briefly described, in its preferred form, the present invention provides a broadhead for an arrow shaft. Referring now in detail to the drawing figures, wherein like reference numerals represent like parts throughout the several views, FIG. 1 shows a first preferred embodiment of a broadhead assembly 10 shown adapted in engagement with an engaging end 12 of an arrow shaft 14 shown in phantom lines.

The broadhead assembly 10 preferably comprises a plurality of blade elements 50, a mandrel 90 having a collar 100, a ferrule 30 and a detachable tip 70.

Figure 2:
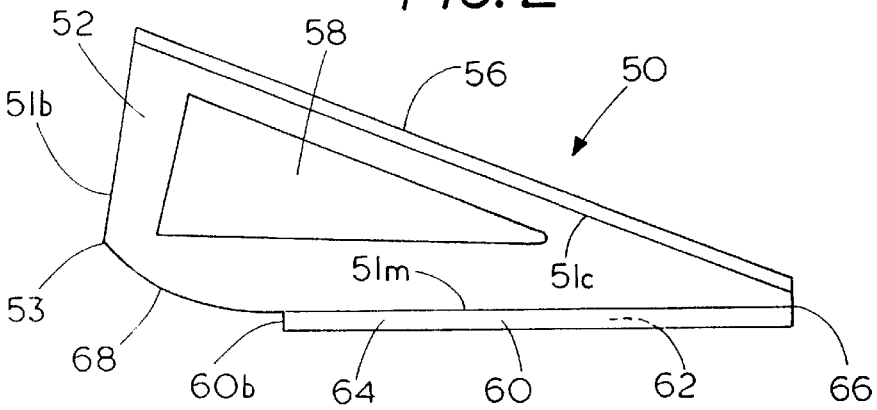
FIG. 2 is a side view of a blade element according to a preferred embodiment of the present invention.
Figure 3:
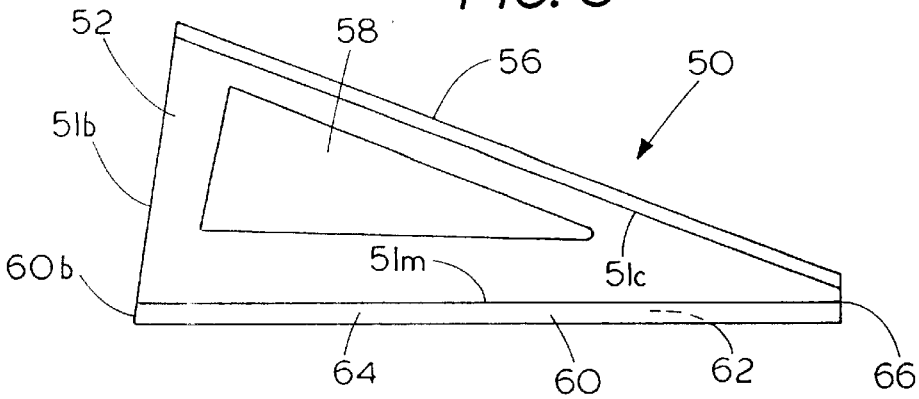
FIG. 3 is a side view of a blade element according to a second preferred embodiment of the present invention.

Illustrated in FIGS. 2 and 3 are side views of typical blade elements 50 of the present broadhead 10. Each blade element 50 preferably forms a generally triangularly shaped planar blade body 52 having a mandrel engaging portion extending from the blade body 52. In these embodiments, the mandrel engaging portion is an arcuate flange portion 60. The blade element 50 is basically defined between a mandrel edge 51*m*, a cutting edge 51*c* and a back edge 51*b*. The cutting edge 51*c* of the blade body 52 includes a sharpened blade 56.

The blade body 52 further defines a generally centrally located cut-out or window 58. The blade window 58 reduces the mass of the blade element 50. The window 58 also reduces the tendency of the broadhead and arrow to follow an unintended trajectory due to a misaligned blade element 50. Where the blade element 50 is misaligned in the ferrule 30, such that the plane of the blade body 52 is inclined slightly from a plane including the central axis of the ferrule 30, air passing over the planar surface of the blade body 52 will be inclined to the planar surface of the blade body 52 causing a differential air pressure distribution on opposing planar surfaces of the blade body 52. The differential pressure can change the trajectory of the arrow or cause unintended arrow spin. The effect of the misalignment is reduced by the window 58 that reduce the surface area over which the differential pressure forces act. The window 58 also promotes more profuse bleeding in wounded animals, thereby hastening death. It will be understood that blade element 50 can incorporate several forms of window 58, and more than one cut-out portion.

In the blade 50 embodiment shown in FIG. 3, the flange portion 60 extends from, and the full length of, the mandrel edge 51*m* of the blade element 50. FIG. 2 illustrates a flange portion 60 only extending a portion of the length of mandrel edge 51*m*. (In FIG. 2, mandrel edge 51*m* meets back edge 51*b* at point 53). In both FIGS. 2 and 3, the flange portion 60 terminates at a bottom edge or bottom surface 60*b*.

Figure 4:
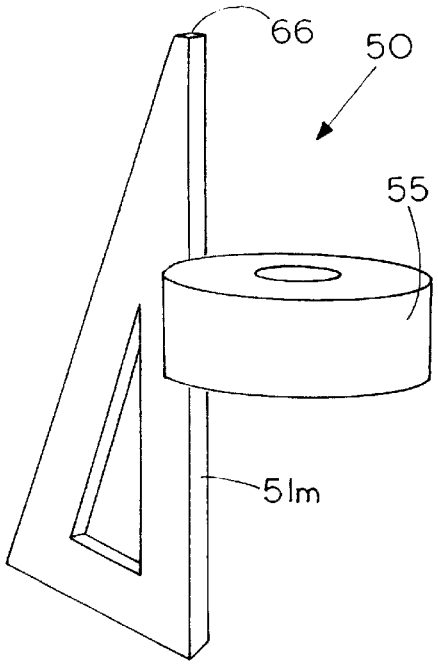
FIG. 4 is a perspective view of a blade element of the present invention incorporating a loop.
Figure 5:
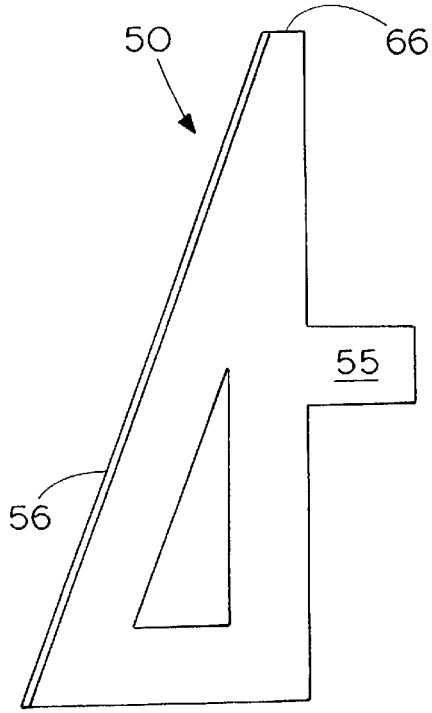
FIG. 5 is a side view of FIG. 4.
Figure 6:
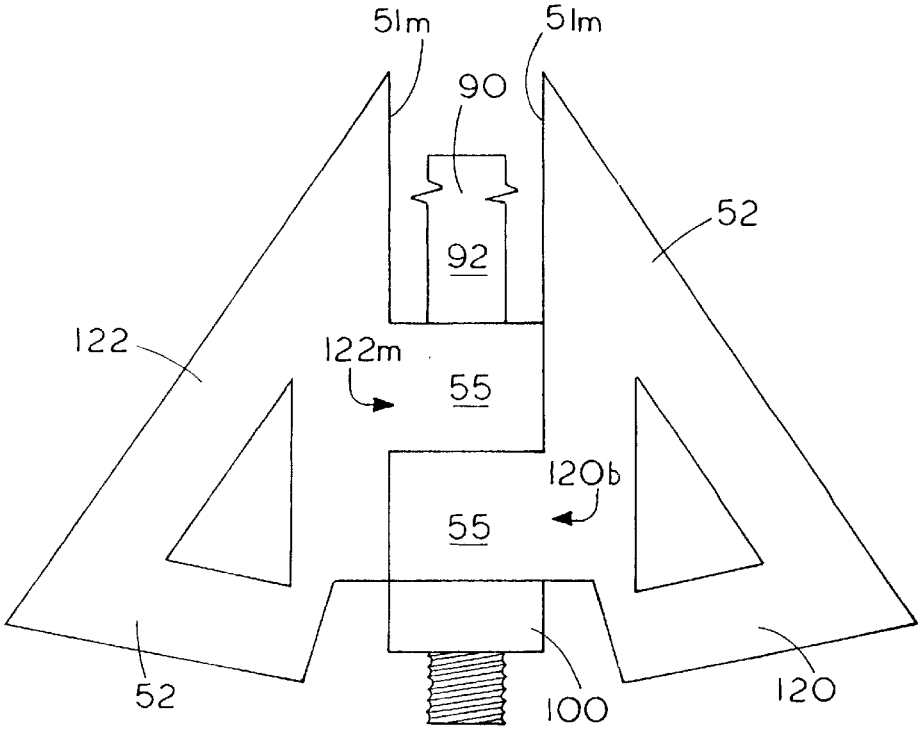
FIG. 6 is a side view of two blade elements each having a loop, wherein the loops are stacked above a collar engaged with a mandrel of the present invention.

In another embodiment of blade element 50 as shown in FIGS. 4 and 5, the mandrel engaging portion is a full loop 55 having an inner diameter incrementally larger than the diameter of the outer surface of the mandrel 90 can extend from mandrel edge 51*m*. The blade element 50 shown in FIGS. 4 and 5 incorporates a mandrel engaging portion that is not a flange portion 60. In this embodiment, the mandrel 90 slips within loop 55, securing blade element 50 to the mandrel 90. Thus, the mandrel engaging portion is loop 55. As shown in FIG. 6, the mandrel edge 51*m* of blade bodies 52 do not engage the outer surface 92 of mandrel 90 when a blade body 52 comprises loop 55 because the loop wraps around mandrel 90. Construction of the assembly shown in FIG. 6 is described supra.

A blade element engages the outer surface 92 of mandrel 90 via the mandrel engaging portion by one or more of the above components (a flange portion 60 and/or a loop 55). In one representative embodiment, a broadhead 10 comprises n blade elements, each blade element having a flange portion 60 that arcuately extends incrementally less than 360/n degrees around the mandrel 90. In this embodiment, the flange portion 60 preferably extends the full length of mandrel edge 51*m* of the blade body 52, as shown in FIG. 3.

Figure 7:
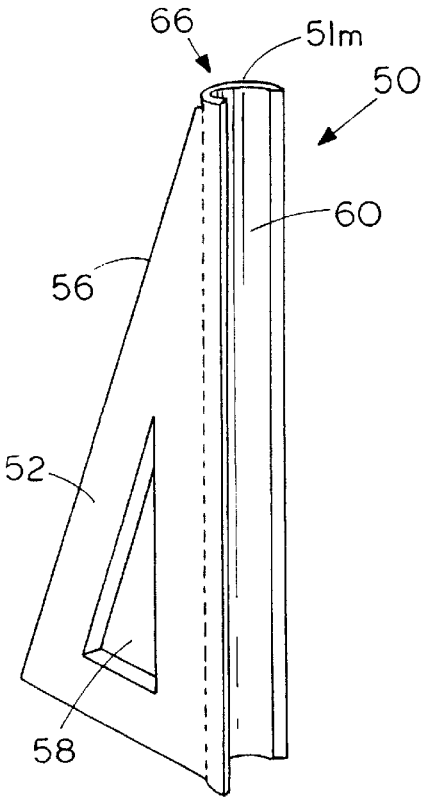
FIG. 7 is a blade element having two flange portions angularly offset from the blade body in opposition direction.

In another embodiment, a blade element 50 as illustrated in FIG. 7 can have two flange portions 60 angularly offset from the blade body 52 in opposite directions, FIG. 7 shows one flange portion angling off blade body 52 to the right (out of the drawing sheet), while another flange portion angles off to the left (into the sheet).

The mandrel engaging portions, flange portion 60 and loop 55, are designed to bend around and contact a portion of the outer surface 92 of mandrel 90 so the blade elements 50 remain in engagement with mandrel 90 throughout flight of the broadhead. Flange portion 60 and loop 55 therefore have common features in order to accomplish this function. Thus, for the sake of brevity, it will be understood that the following detailed description of specific features of a flange portion 60 relate to similar features/functions of a loop 55.

Returning to FIGS. 2 and 3, the flange portion 60 has an inner flange side 62 that engages the outer peripheral surface 92 of the mandrel 90, and an outer flange side 64 that engages the inner surface of the ferrule 30, when the broadhead assembly 10 is assembled. Further, the flange portion 60 can be coterminous with the sharpened edge 56 at a leading end 66 of the blade element 50. The flange portion 60 also can be truncated adjacent an arcuate edge 68 of mandrel edge 51*m* as shown in FIG. 2, or can be coterminous with the back edge 51*b* of the blade element 50 illustrated in FIG. 3.

As shown in FIG. 2, the back edge 51*b* joins the arcuate edge 68 and the sharpened edge 56. FIG. 3 shows the back edge 51*b* joining mandrel edge 51*m* and the sharpened edge 56, the blade body of FIG. 3 not incorporating an arcuate edge 68. The back edge 51*b* is usually blunt; however, in some applications, can be sharpened.

Figure 8:
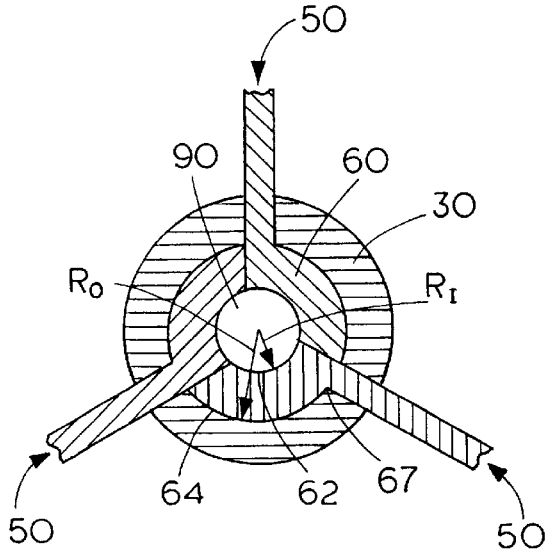
FIG. 8 is a sectional view of a broadhead assembly according to one embodiment of the present invention having three blade elements.

When viewed in an end elevation, the flange portions 60 of the three blade elements 50 shown in FIG. 8 are curved outwardly of a bend line 67 such that they define an inner radius of curvature $R_I$ of the inner flange side 62. The flange portion 60 further defines an outer radius of curvature $R_O$ of the outer flange side 64. The flange portion 60 radii of curvature $R_I$ and $R_O$ are sized to be substantially equal to the radii of curvature of the outer surface 92 of mandrel 90 and the inner surface of the ferrule 30, respectively.

As further shown in FIG. 8, each flange portion 60 of each blade element 50 contacts the adjacent blade element 50 so that, when viewed in an elevation, the cavity formed between mandrel 90 and ferrule 30 is substantially free of voids. Since substantially all of the cavity is filled by blade element 50 having a flange portion 60, this arrangement is more secure in flight and upon striking the target since there is little to no shift of blade elements 50. Thus, as described before, each blade element of FIG. 8 incorporates a flange portion 60 that angularly extends incrementally less than 360 divide n degrees around the mandrel, allowing for the thickness of the blade. In this fashion, each flange portion 60 abuts an adjacent blade and substantially no void space exists between the inner surface of ferrule 30 and the outer surface 92 of mandrel 90.

Figure 9:
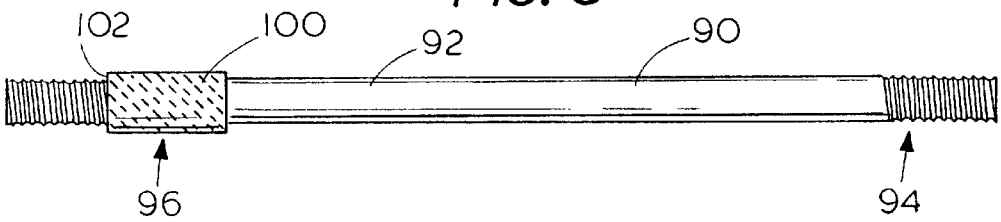
FIGS. 9–14 illustrate varying embodiments of a mandrel and collar assembly.

Broadhead 10 of the present invention further comprises mandrel 90 preferably including a collar 100 adjustably attached to the bottom section of the mandrel 90. As shown in FIGS. 9–14, mandrel 90 comprises a rod 90 preferably of uniform diameter. Mandrel 90 has an outer surface 92, a front section 94 and back section 96. The mandrel 90 is an inner component of broadhead 10 preferably communicating with the blades 50, tip 70, collar 100 and arrow shaft 14. FIG. 9 illustrates a mandrel 90 having outer threaded portions cut both in the front and back section 94, 96, respectively. The mandrel of FIG. 9 threadedly engages tip 70 at front section 94, and threadedly engages ferrule 30 at back section 96. Preferably located at the back section 96 of mandrel 90 is a collar 100. Again referring to FIG. 9, collar 100 threadedly engages mandrel 90 by providing a collar 100 with a threaded bore 102. It will be understood that mandrel 90 can engage tip 70 and ferrule 30 in a variety of other attachment means. Similarly, collar 100 can engage mandrel 90 in numerous ways.

Figure 10:
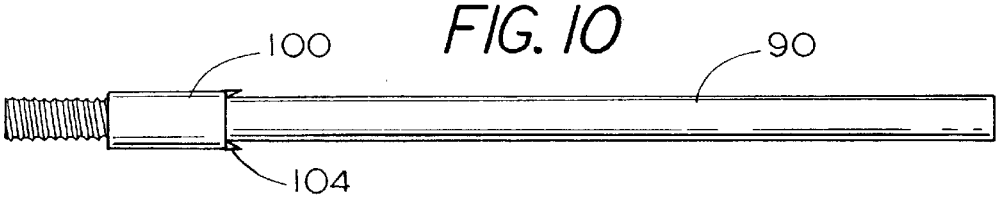
Figure 11:
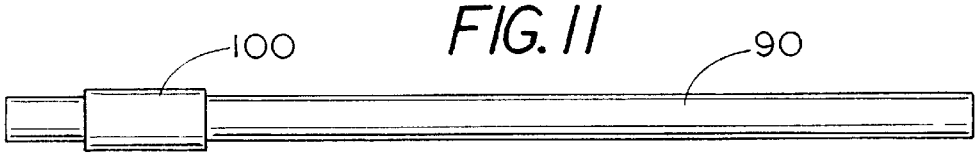

As shown in FIGS. 9–14, mandrel 90 can comprise varying threaded portions and smooth portions, and collar 100 can comprise various shapes and surface textures. FIGS. 9–12 and 14 illustrate collar 100 having a smooth cylindrical outer surface. FIG. 10 shows mandrel 90 having a threaded portion only at its back section 96, and a collar 100 comprising a chamfer 104. FIG. 11 illustrates a mandrel 90 having no threaded portions, and a collar 100 that is non-adjustable. As shown in FIG. 11, collar 100 may be formed integral with mandrel 90 or can be press-fit at the back end 96 of mandrel 90.

Figure 12:
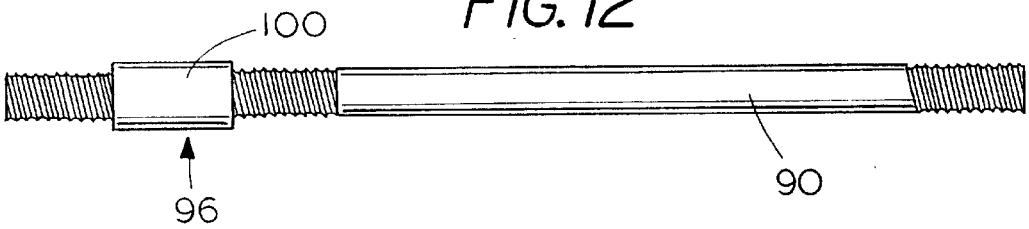
Figure 13:
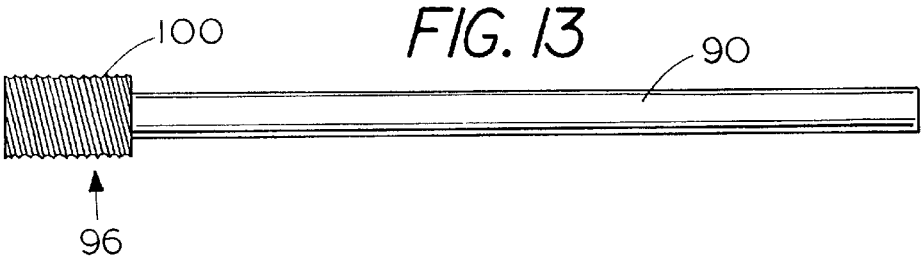
Figure 14:
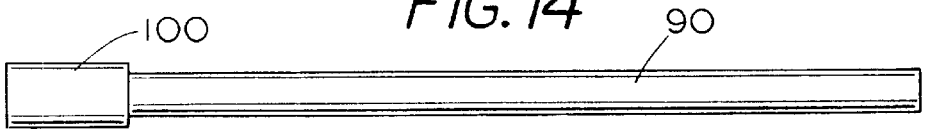

FIG. 12 illustrates the mandrel 90 of FIG. 9, with a longer threaded portion at the back section 96. FIG. 13 illustrates mandrel 90 having a collar 100 at its lower end 96, wherein mandrel 90 terminates in collar 100. FIG. 13 further depicts collar 100 having outer threading, which embodiment of collar 100 may be applied to any of the various figures of the mandrel 90. FIG. 14 depicts a smooth-surfaced mandrel 90 terminating in collar 100 also having an outer smooth surface, wherein collar 100 is press-fit onto the back end 96 of mandrel 90.

Figure 15:
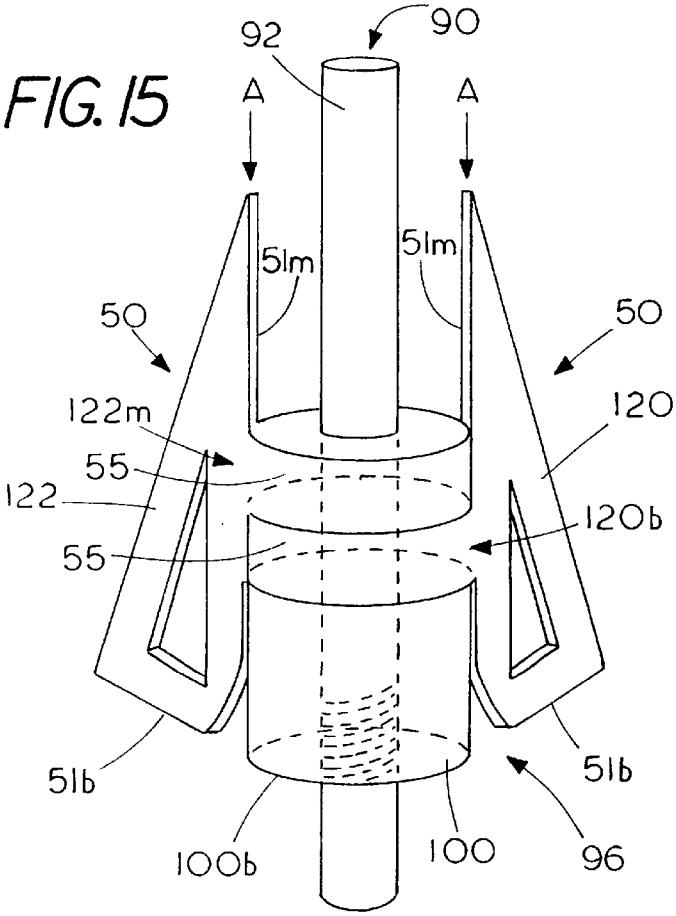
FIG. 15 is a perspective view of partially assembled broadhead according to another embodiment of the present invention.

The collar 100 ultimately supports each blade element 50 upon broadhead 10 assembly. In the embodiment of FIG. 8, utilizing blade elements 50 as shown in FIGS. 2 and 3, the bottom edge or surface 60*b* of each of the three flange portions 60 would rest on the top surface of the collar 100. Alternatively, as shown in FIGS. 6 and 15, the bottom surface of the bottom loop 120*b* of blade 120 contacts the top surface of the collar 100, with loop 122*m* of middle blade 122 supported atop loop 120*b* and by collar 100. assembly of the broadhead 10 of the present invention, the blade elements 50 are designed to engage around mandrel 90, preferably by snap-fit, with the mandrel engaging portion of the blade element (flange portion 60 or loop 55). FIG. 15 shows two blades 50 of a three-bladed broadhead 10, illustrating bottom blade element 120 and middle blade element 122. Each blade element 120, 122 comprises a loop 55. Blade elements 120, 122 are designed so that their respective loops 55 extend from the mandrel edges 51*m* of both the bottom portion 120*b* of blade element 120 and the middle portion 122*m* of blade element 122, respectively. Thus, when blade elements 120, 122 are slid over a mandrel 90 having disposed at its back end 96 a collar 100, bottom blade element 120 rests in contact with collar 100 via loop 120*b*, and middle blade element 122 rests on top of loop 120*b* of bottom blade element 120 via loop 122*m* in a stacked configuration, while the blade bodies 120, 122 begin and end at equal lengths along the length of the mandrel 90.

The broadhead illustrated in FIG. 15 would be propelled in a direction of travel opposite the directional arrows A. Upon striking its target, blade elements 120, 122 experience longitudinal stresses in the direction of arrows A. These stresses are eventually resisted by the collar 100 via the transmission of forces through the respective loops of the blades. Unlike blade assemblies comprising blade elements having only notches that engage a small portion of the ferrule, and thus provide only a minimum of surface area contact between the ferrule and the blade element, the present blade assembly provides a larger contact surface upon which the longitudinal stresses may dissipate, limiting the damage to the blades and ferrule.

Regarding assemblies incorporating blades having flange portions, the mandrel 90 is sized and configured to discourage movement of the blade element 50 when the flange portion 60 is in contact with mandrel 90. The mandrel 90 is urged into engagement with the inner flange side 62 of flange portion 60, and the outer flange side 64 is urged into engagement with the cavity side wall 44 of the ferrule 30, discussed below and shown in FIG. 16. The clearances between the cavity side wall 44 and the outer flange side 64, and the mandrel 90 peripheral surface 92 and the inner flange side 62 are minimal, if not entirely eliminated. However, the mandrel 90 need not, necessarily, be in compressive engagement with flange portion 60 and the cavity side wall 44. This avoids the need of hand tools or presses to assemble the broadhead assembly 10 of the present invention.

All of the blade element configurations shown in the figures can utilize mandrels 90 having circular cross-sections. Faceted mandrels can also be used selectively with the broadhead assembly 10. For example, broadhead assemblies 10 supporting angularly offset flange portions 60 can utilize a faceted mandrel.

Figure 16:
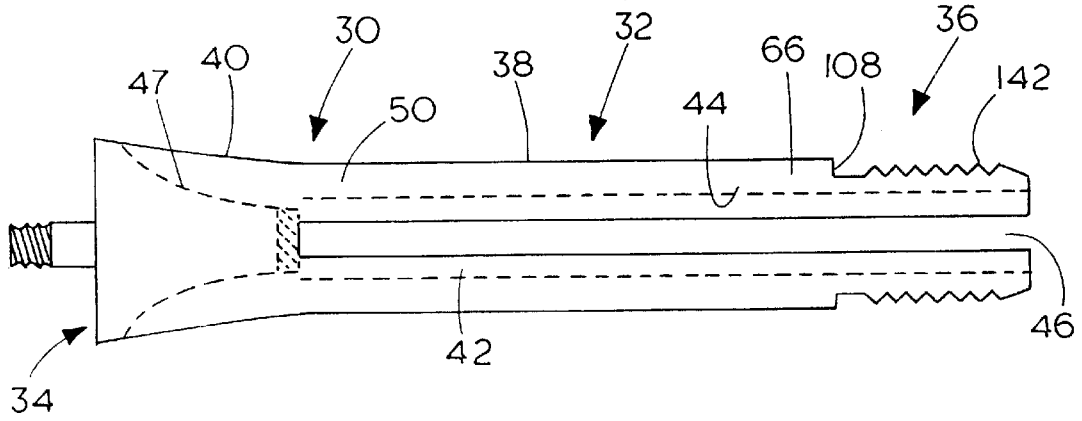
FIG. 16 is a side view of a ferrule of the present invention according to a preferred embodiment.
Figure 17:
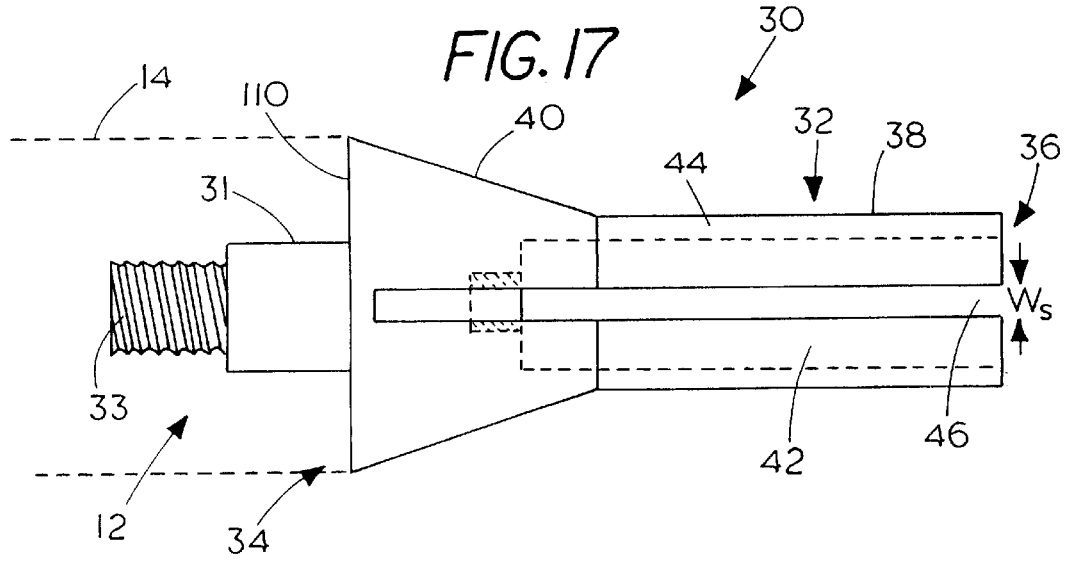
FIG. 17 is a side view of a ferrule of the present invention according to another embodiment.

The broadhead 10 of the present invention further comprises ferrule 30. As shown in FIGS. 16 and 17, the ferrule 30 of broadhead 10 includes a blade mounting portion 32, a ferrule collar end 34, and an opposed open, tip end 36. The ferrule 30 is typically fabricated of an aluminum alloy, however other materials such as alternative metals and plastics are within the contemplation of the present invention.

The blade mounting portion 32 of the ferrule 30 comprises the major length of the ferrule 30 and is the mounting site of the blade elements 50. The blade mounting portion 32 defines a generally circular cross section and includes a forward section 38, which defines a first constant ferrule diameter, and a rearward flared section 40 having a varying diameter, the diameter of the forward section 38 being smaller than the diameter of the flared section 40. The reduced diameter of the forward section 38 results in lowered weight and increased penetration of the broadhead assembly 10 by reducing the drag surface area of the broadhead 10. The flared section 40 provides a transition between the forward section 38 of the ferrule 30 and the diameter of the arrow shaft 14.

The forward section 38 of the ferrule 30 defines a longitudinally extending central cavity 42 that is aligned along the central axis of the ferrule 30. As shown in FIGS. 16 and 17, the cavity 42 extends between the closed, ferrule collar end 34 and the open, tip end 36. The ferrule 30 has a thickness indicated by the cavity side wall 44. In one embodiment of the present invention, the central cavity 42 is a hollow central cavity which can be formed by drilling along the central axis of the ferrule 30 with a drill having a prescribed diameter to a prescribed depth through the forward section 38. Thus, a solid cylinder of material is removed from the ferrule 30 to form the central cavity 42. The cavity 42 remaining after drilling can then be reamed to a precise diameter.

The forward section 38 of the blade mounting portion 32 further comprises a plurality of longitudinally extending slots 46, one slot 46 for each blade element 50 intended to be supported by the ferrule 30. Each slot 46 defines a width $W_S$ incrementally greater than the width of the blade elements 50. Each ferrule slot 46 communicates between the outer peripheral surface of the ferrule 30 and the ferrule cavity 42. The slots 46 can be formed by conventional machining techniques such as by sawing with a circular slitting saw. The slots 46 can be formed to extend radially from the cavity 42. Alternatively, the slots 46 can be disposed in the ferrule 30 in planes parallel to planes tangent to the peripheral surface of the ferrule 30.

Figure 18:
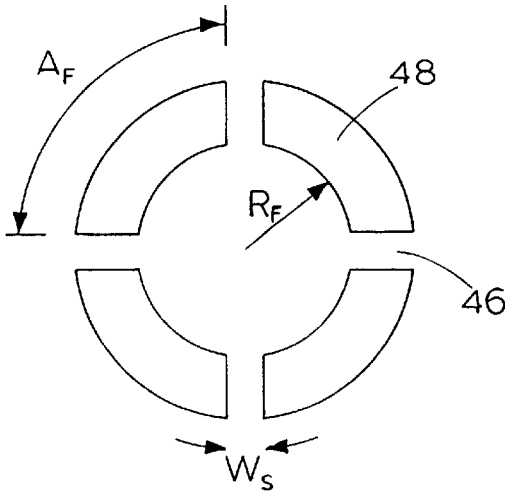
FIG. 18 is a sectional view of a four bladed ferrule of the present invention.

In a preferred embodiment of, for example, a four-bladed broadhead 10, illustrated in FIG. 18 is a cross-section of the forward section 38 of ferrule 30 generally comprising four equal length and thickness ferrule strips or fingers 48, each having an identical radius of curvature $R_F$, and each having an equal arc of curvature $A_F$ equal to $(360-4W_s)/4$ degrees. These four strips 48 meet at flared section 40 as slots 46 terminate at flared section 40. Flared section 40 generally comprises a hollow cone flaring out from forward section 38.

Each slot 46 of ferrule 30 can further define an arcuate portion 47 as shown in FIG. 16 which is formed by the circular slitting saw as it enters into, or emerges from, the ferrule 30. Portions of the blade elements 50 can be configured to accommodate the arcuate portion 47 of the slot 46.

The complement of blade elements 50 included in a particular broadhead assembly 10 is determined, in part, by the application of the broadhead 10 and the individual preferences of the archer. Broadheads with fewer blade elements are generally lighter in weight than those with more blade elements. However, broadheads having more blade elements have greater cutting power owing to the increased number of cutting edges present. Therefore, there is a compromise between broadhead weight, which affects the speed and trajectory of the arrow, and the cutting power of the arrow.

The number of blade elements 50 supported by the broadhead assembly 10 is also limited by the width $W_S$ of ferrule slot 46 and the blade element 50 design. When the slots 46 are cut, or otherwise formed in the ferrule 30, the forward section 38 of the blade mounting portion 32 becomes segmented into a plurality of upstanding ferrule fingers 48. As the number of slots 46 formed in the ferrule 30 increases, the arc of curvature $A_F$ of the ferrule fingers 48 decreases, thereby weakening to some degree the ferrule fingers 48 relative to a ferrule 30 having fewer slots 46. Weakened ferrule fingers 48 can not withstand the forces transmitted to and through the broadhead assembly 10 under some shooting conditions. Thus, with an increase of the arc of curvature of the ferrule fingers 48, the higher the strength of the broadhead 10.

In another embodiment of a broadhead 10, each blade body 52 comprises a flange portion 60 extending substantially the fall length of blade body 52, and incrementally less than $(360-n\cdot W_s)/n$ degrees around the outer surface 92 of the mandrel 90, where n equals the number of blade elements comprising the broadhead 10.

Figure 24:
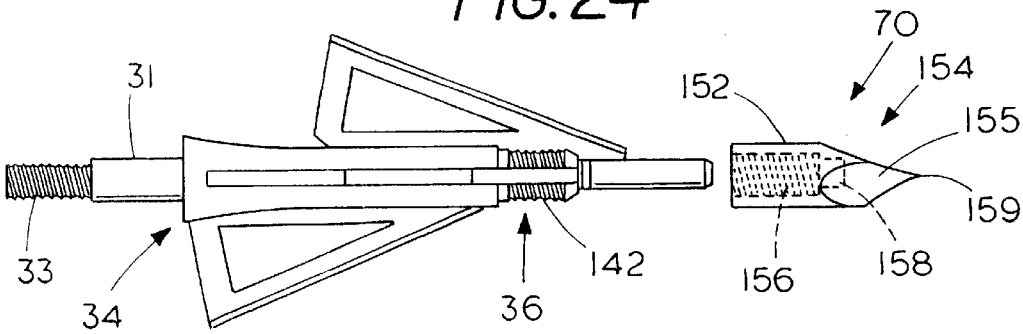
FIG. 24 is side view of a preferred embodiment of a broadhead assembly of the present invention.

Extending from collar end 34 of ferrule 30, ferrule extension 31 sticks out preferably as a smooth tubular extension for insertion into a bore of the arrow shaft as shown in FIGS. 17 and 24. Thread 33 can itself extend from ferrule extension 31 in order to facilitate a more secure fastening of broadhead 10 to the arrow shaft.

Figure 19:
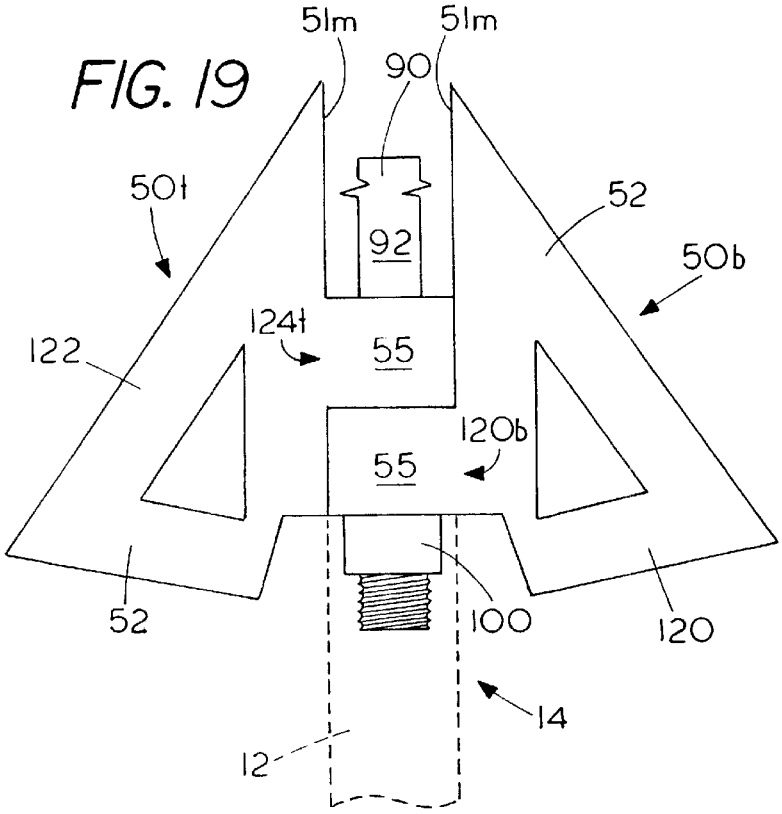
FIG. 19 is a side view of a broadhead assembly without a ferrule.
Figure 20:
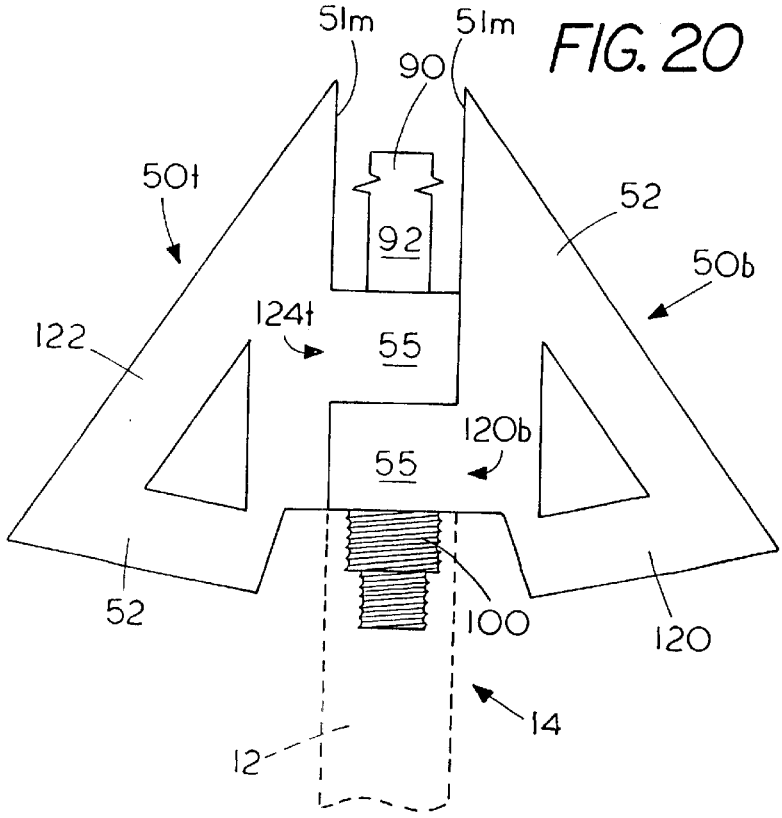
FIG. 20 is a side view of another broadhead assembly without a ferrule.

In yet another preferred embodiment, the present broadhead assembly 10 can comprise blade elements 50 having at least one loop 55, a mandrel 90 having an adjustable collar 100, a circumferential locking assembly 160 and a tip 70, as illustrated in FIGS. 19–23. The mandrel 90 extends through the loop 55 of each blade 50, wherein the broadhead assembly 10 comprises at least two blades 50, a top and a bottom blade **50*t*, 50*b*, and the loop 120*b* of the bottom blade 50*b* rests atop the collar 100. FIGS. 19 and 20 illustrate the assembly 10 according to this embodiment adapted in engagement with an engaging end 12 of an arrow shaft 14 shown in phantom lines. The broadhead of FIG. 19 utilizes the mandrel and collar sets shown in FIGS. 9, 10 and/or 12, and the broadhead of FIG. 20 utilizes similar sets, with collar 100 having outer threads. It will be understood that FIGS. 19 and 20 only show representative examples of the embodiment of assembly 10** having no ferrule, and that other mandrel and collar set embodiments can be used.

Figure 21:
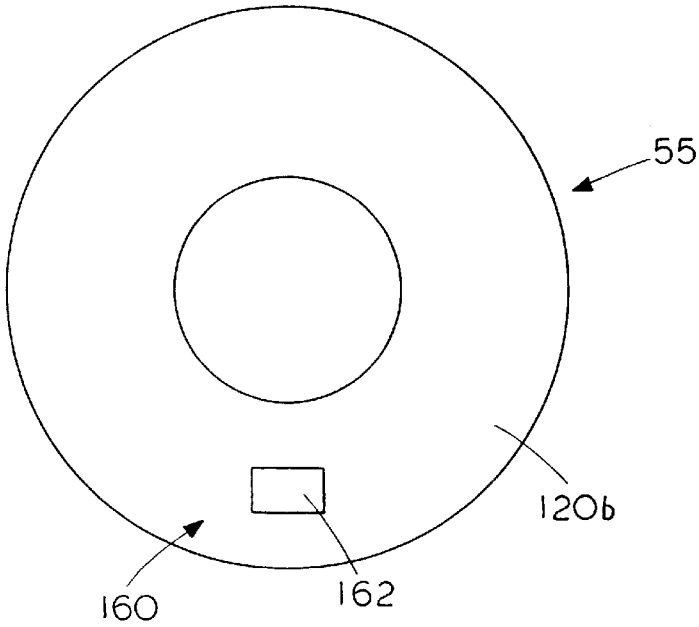
FIG. 21 is a top view of a loop of a blade element, the loop incorporating a recess.
Figure 22:
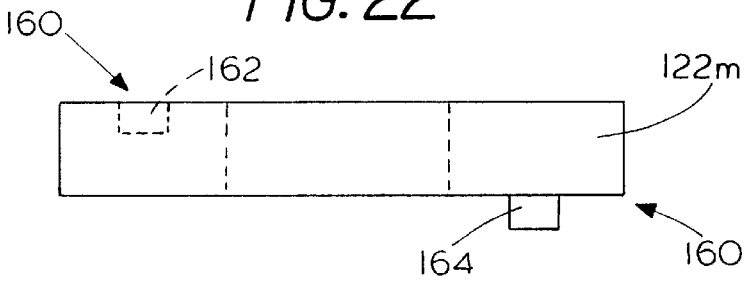
FIG. 22 is a side view of loop of a blade element, the loop incorporating a recess and a tab.
Figure 23:
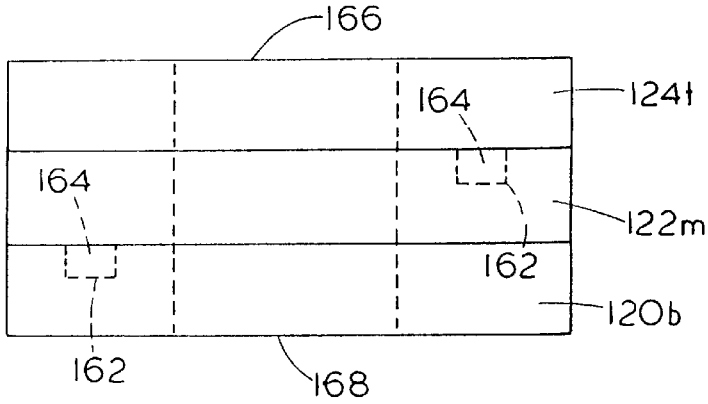
FIG. 23 is a side view of stacked loops of FIGS. 21 and 22.

One embodiment of circumferential locking assembly 160 is illustrated in FIGS. 21–23. The locking assembly 160 locks an individual blade element 50 from shifting circumferentially around the mandrel 90 relative to other blade elements 50 once the blades have been placed in proper alignment upon construction of the broadhead. Locking assembly 160 preferably releasably locks the blade elements 50 together such that if there is any circumferential motion of the blade elements 50 relative to the mandrel 90, the blade elements 50 shift as a single unit, thus fixing the circumferential relationship of the blade bodies 52 to one another. In another embodiment of locking assembly 160, each blade is releasably secured to another blade as discussed above, and the blades are further secured against circumferential rotation through communicative engagement with the tip 70, the collar 100, or both.

As shown in FIG. 21, loop **120*b* of a bottom blade has a recess 162 extending a depth into loop 120*b*. FIG. 22 illustrates a loop 122*m* of a middle blade having both a recess 162, and a locking tab 164 extending from loop 122*m*. Locking tab 164 is designed to fit snug into a recess 162 of another loop. FIG. 23 shows a representative example of how three blades 50 having loops 120*b*, 122*m*, and 124*t*, respectively, stack into a locked configuration. Top loop 124*t* has extending therefrom a locking tab 164 that is in engagement with the recess 162 of middle loop 122*m*. Middle loop 122*m* has recess 162 accepting locking tab 164 of loop 124*t*, and has extending therefrom a locking tab 164 that is in engagement with the recess 162 of bottom loop 120*b*. Surface 166 of top loop 124*t*, and surface 168 of bottom loop 120*b*, engage the tip 70 and the collar 100**, respectively.

The location of recesses 162 and locking tabs 164 are appropriately placed so the blade bodies are secured in a proper configuration throughout flight. For example, for a three blade broadhead 10, the locking assembly 160 can lock the relative position of the loops (and therefore the blades) so each blade body is 120 degrees rotated from another blade body. Thus, should the blades rotate around mandrel 90, they will rotate in lock step with each other and remain 120 degrees separated from one another. It will be understood that several embodiments of locking assembly 160 are contemplated, and can comprise, for example, more than one recess 162 and locking tab 164 per loop, or an interlocking top and bottom surface of each loop which surfaces interconnect with adjacent surfaces of adjacent loops. Further, it will be understood that FIG. 23 represents but one embodiment of stacked loops. Alternatively, surface 168 of bottom loop 120*b* (which surface 168 contacts the top surface of collar 100 upon assembly), can itself lock in circumferential relationship with collar 100. For example, although not shown, bottom loop 120*b* can incorporate a locking tab 164 that fits within a recess 162 located in the top surface of the collar 100, or vice versa. Similarly, surface 166 of top loop 124*t* (which surface 166 contacts the bottom surface of tip 70 upon assembly), can itself lock in circumferential relationship with tip 70.

The broadhead 10 of the present invention further comprises tip 70 that caps the present broadhead 10, and secures the assembly together. The tip 70 secures the blade elements 50 within the ferrule 30, supports the ferrule fingers 48 and provides a sharp tip for initiating piercing of the object at which the arrow is shot. In one embodiment, shown in FIG. 24, the tip end 36 of the ferrule 30 can be provided with threads 142 that are adapted to threadedly receive a tip 70 having an internally threaded receiving bore.

Figure 25:
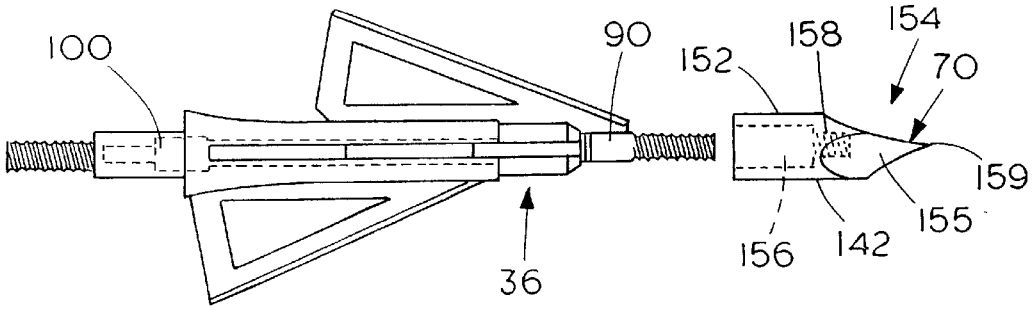
FIG. 25 is a side view of a second preferred embodiment of a broadhead assembly of the present invention.
Figure 26:
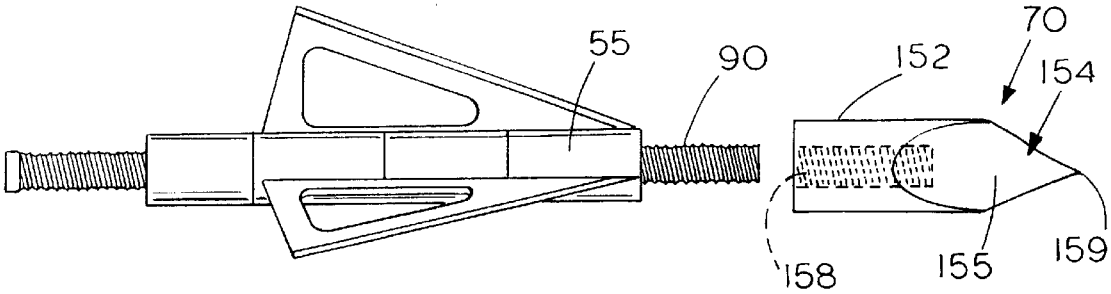
FIG. 26 is side view of a third preferred embodiment of the broadhead assembly of the present invention.

The tips 70 shown in FIGS. 1 and 24–25 are trocar tips comprising a cylindrical barrel 152 and a tri-faceted point 154, comprising a plurality of facet faces 155 extending from the cylindrical barrel 152 to a tip apex 159. Other tip point configurations, such as four faceted and conical points are well known in the art. The facet faces 155 can be planar in configuration or can define a curved surface configuration.

Tips 70 adapted for use with ferrules 30 having a threaded tip end 36 are provided with a relatively long cylindrical barrel 152 which defines an internally threaded receiving bore 156 having threads, as shown in FIG. 24. The threads are adapted to threadedly engage the threads 142 of the ferrule tip end 36. A smooth bore 158 extends further into tip 70 beyond bore 156 to accept the extension of mandrel 90 beyond the threaded tip end 36 of ferrule 30, should mandrel 90 so extend.

FIG. 25 illustrates another embodiment of tip 70 assembly, wherein the tip end 36 of ferrule 30 has a smooth outer diameter and mandrel 90 extends beyond the tip end 36, such mandrel extension being threaded. Tip 70 has a smooth internal receiving bore 156 to accommodate the tip end 36 of ferrule 30, and tip 70 further comprises a threaded bore 158 beyond bore 156 to accept the threaded portion of mandrel 90.

Preferably, the outside diameter of the cylindrical barrel 152 of the tip 70 is substantially equal to the outside diameter of the tip section 36 of ferrule 30. This provides a smooth transition between the tip 70 and the ferrule 30 to insure desirable aerodynamics of the broadhead assembly 10 at the transition point. Accordingly, when tip end 36 comprises a threaded portion 142, the outside diameter of the threads is reduced relative to the tip section 36 adjacent the threads.

Other tip 70 and mandrel 90 assemblies can be joined together by conventional means such as press fitting, which is well known.

The broadhead 10 is mounted to the top of an arrow shaft 14 at the engaging end 12 of the shaft 14 as shown in FIG. 1. The engaging end of the broadhead 10 comprises the collar end 34 of ferrule 30, ferrule extension 31 and threaded portion 33, shown in FIGS. 17 and 24. Those skilled in the art of archery broadheads will appreciate that there are means other than the extension 31 and/or threading 33 for engaging the broadhead assembly 10 with an arrow shaft 14. Ferrule extension 31 can be integral with the ferrule 30 and be designed to cooperate with an arrow shaft adapted for glue mounted broadheads. The threaded cylindrical extension 33 can be integral with ferrule extension 31, which threading engages a mating threaded portion in the arrow shaft 14.

The collar end 34 of the broadhead 10 can also define an abutting shoulder 110 against which the transverse face of the engaging end 12 of the arrow shaft 14 abuts when the broadhead assembly 10 is secured to the arrow shaft 14. As shown in FIG. 17, the diameter of the abutting shoulder 110 of ferrule 30 can be substantially equal to the diameter of the arrow shaft 14 adjacent the arrow engaging end 12. The equivalent diameters prevent abrupt changes in diameter that can tend to alter the aerodynamic balance of the arrows during flight and generally allows greater penetration into a target.

Ferrule extension 31 of ferrule 30 is adapted to be journalized within a receiving bore defined within the arrow shaft 14. The clearance between the outer peripheral surface of extension 31 and the receiving bore is defined to provide precise alignment of the longitudinal axes of the broadhead assembly 10 and the arrow shaft 14 in a well known manner. The precise alignment of the broadhead 10 with the arrow shaft 14 helps to maintain the aerodynamic balance of a complete arrow assembly. The threaded stud 33 of extension 31 is adapted to be received in a cooperating threaded aperture formed within the arrow shaft 14, along the longitudinal axis thereof.

Alternatively, the present broadhead 10 can mount to an arrow shaft 14 as previously described and shown in FIGS. 19 and 20, wherein the collar 100 replaces, in effect, the ferrule extension 31 of FIGS. 1, 17 and 24.

Broadhead assemblies 10 comprising a ferrule 30 and blade elements 50 having angularly offset flange portions 60, both curved and planar, are assembled by inserting, longitudinally, the bottom edge 60*b* of the blade element 50 into the ferrule slots 46 from the open end 36 of the ferrule 30. The blade element 50 is moved longitudinally within the cavity 42 until the flange portion 60 engages collar 100. Then the mandrel 90 is inserted into the cavity 42 so that the mandrel 90 engages the inner flange side 62 of the blade elements 50. Alternatively, the blade elements 50 may be fitted against mandrel 90, and then the blades and mandrel slipped into ferrule cavity 42.

Broadhead assemblies 10 comprising a ferrule 30 and blade element 50 having loops 55 are assembled by inserting, longitudinally, loop 55 of blade element 50 into the ferrule slots 46 from the open end 36 of the ferrule 30. The blade element 50 is moved longitudinally within the ferrule cavity 42 until the loop of the first inserted blade engages collar 100. Each additional blade is then inserted with each loop 55 sitting atop the previous loop. Then the mandrel 90 is inserted into the ferrule cavity 42 so that the mandrel 90 engages the inner surface of loops 55.

In a broadhead assembly comprising blade elements 50 having more than one loop 55, wherein each loop 55 occupies a free portion of the length of the mandrel 90 upon assembly of the broadhead, loops 55 of each blade body 50 are first aligned somewhat similar to the hinge of a door wherein each hinge comprises a blade element, and the pin comprises the mandrel, and then the assembly is slid into ferrule cavity 42. Mandrel 90 is then slipped within loops 55.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An archery broadhead assembly comprising:

(a) at least one blade element, said blade element incorporating a substantially planar blade body defining a cutting edge, a mandrel edge and a back edge, said at least one blade element further including a mandrel engaging portion attached to and extending from said mandrel edge of said blade body, (b) an elongate mandrel having a front and a back end, said mandrel effective to engage said mandrel engaging portion of said at least one blade element;

(c) a collar engageable with said mandrel at said back end, said collar supporting said at least one blade element.

2. The archery broadhead assembly of claim 1, further comprising a circumferential locking assembly to secure the circumferential relationship of said at least one blade element relative to said mandrel.

3. The archery broadhead assembly of claim 1, having at least two blade elements and further comprising a circumferential locking assembly to secure the circumferential relationship of said at least two blade elements relative to each other.

4. The archery broadhead assembly of claim 3, wherein said mandrel engaging portion of each of said at least two blade elements comprises at least one loop through which said mandrel can extend.

5. The archery broadhead assembly of claim 4, wherein said circumferential locking assembly comprises a recess in at least one loop of at least one said blade element, and a tab extending from at least one loop of another said blade element, said tab engagable within said recess to lock the circumferential relationship of said at least two blade elements relative to each other.

6. The archery broadhead assembly of claim 5, wherein said locking assembly further locks the circumferential relationship of said at least two blade elements relative to said mandrel.

7. The archery broadhead assembly of claim 1, further comprising a ferrule, said ferrule including an elongate ferrule body having an outer peripheral surface, an arrow shaft engaging end and an opposed tip end, said ferrule body defining an axially extending centrally located ferrule cavity including an inner cavity side wall, said ferrule body further defining at least one ferrule slot extending longitudinally along said ferrule body and communicating between said outer peripheral surface and said ferrule cavity.

8. The archery broadhead assembly of claim 7, wherein said mandrel engaging portion of said at least one blade element comprises an arcuate flange portion.

9. The archery broadhead assembly of claim 7, wherein said mandrel engaging portion of said at least one blade element comprises a loop through which said mandrel can extend.

10. An archery broadhead assembly comprising:

(a) a ferrule, said ferrule including an elongate body having an outer peripheral surface, an arrow shaft engaging end and an opposed tip end, said ferrule body defining an axially extending centrally located ferrule cavity including an inner cavity side wall, said ferrule body further defining at least one ferrule slot extending longitudinally along said ferrule body and communicating between said outer peripheral surface and said ferrule cavity;

(b) at least one blade element, said blade element incorporating a substantially planar blade body defining a cutting edge, a mandrel edge and a back edge, said at least one blade element further including a mandrel engaging portion attached to and extending from said mandrel edge of said blade body, said at least one blade element being adapted to be secured in said ferrule slot such that said blade body, including said cutting edge, extends through said slot and outwardly of said peripheral surface, and said mandrel engaging portion and said mandrel edge are disposed with said ferrule cavity;

(c) an elongate mandrel having a front and a back end disposed within said ferrule cavity, said mandrel effective to engage said mandrel engaging portion of said at least one blade element substantially along the length of said mandrel engaging portion between said mandrel and said cavity side wall to discourage movement of said at least one blade element relative to said ferrule slot; and (d) a collar engageable with said mandrel at said back end, said collar supporting said at least one blade element.

11. The broadhead assembly of claim 10, further comprising a broadhead tip adapted to be engaged with said ferrule tip end to prevent longitudinal movement of said at least one blade element relative to said slot.

12. The broadhead assembly of claim 11, wherein said cavity has an open end, adjacent said tip end of said ferrule, and a closed end, adjacent said shaft engaging end of said ferrule, said broadhead tip threadedly engaging said ferrule adjacent said tip end of said ferrule to close said open end of said ferrule cavity.

13. The broadhead assembly of claim 12, wherein said ferrule defines a threaded aperture extending longitudinally of said ferrule body and opening into said closed end of said cavity, and said mandrel having a threaded back end opposite said front end, said threaded back end adapted to be threadedly received in said threaded aperture of said ferrule to cause said mandrel to be disposed in engagement with said ferrule.

14. The broadhead assembly of claim 10, wherein said at least one ferrule slot comprises a plurality of ferrule slots, said ferrule slots extending from said ferrule in planes spaced radially from and parallel to the axis of said ferrule, and, wherein said at least one blade element includes a plurality of blade elements, said mandrel engaging portion of each blade element extending from said blade body in coplanar relation thereto, said mandrel engaging portion defining a first flange side and an opposed second flange side.

15. The broadhead assembly of claim 14, wherein, said blade elements are configured so that said blade elements are interchangeable with said ferrule without regard for the number of said ferrule slots defined in said ferrule.

* * * * *